US011227577B2

(12) United States Patent
VanBlon et al.

(10) Patent No.: US 11,227,577 B2
(45) Date of Patent: Jan. 18, 2022

(54) NOISE CANCELLATION USING DYNAMIC LATENCY VALUE

(71) Applicant: Lenovo (Singapore) Pte. Ltd., Singapore (SG)

(72) Inventors: Russell Speight VanBlon, Raleigh, NC (US); John Weldon Nicholson, Cary, NC (US); John Carl Mese, Cary, NC (US); Nathan J. Peterson, Oxford, NC (US); Arnold S. Weksler, Raleigh, NC (US); Mark Patrick Delaney, Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 16/836,455

(22) Filed: Mar. 31, 2020

(65) Prior Publication Data

US 2021/0304723 A1 Sep. 30, 2021

(51) Int. Cl.
*G10K 11/178* (2006.01)

(52) U.S. Cl.
CPC ..... *G10K 11/1785* (2018.01)

(58) Field of Classification Search
None
See application file for complete search history.

(56) References Cited

U.S. PATENT DOCUMENTS

| | | | | |
|---|---|---|---|---|
| 9,437,211 | B1 * | 9/2016 | Su | G10L 21/0216 |
| 2011/0091047 | A1 * | 4/2011 | Konchitsky | G10K 11/17881 381/71.11 |
| 2016/0036962 | A1 * | 2/2016 | Rand | H04W 76/25 455/418 |
| 2019/0028528 | A1 * | 1/2019 | Dolson | H04L 65/80 |

* cited by examiner

*Primary Examiner* — James K Mooney
(74) *Attorney, Agent, or Firm* — Ference & Associates LLC

(57) ABSTRACT

One embodiment provides a method, including: detecting audio being supplied across an electronic communication medium, wherein the audio comprises at least one noise other than a speaker; minimizing the at least one noise by dynamically adjusting a latency of the audio being supplied to a recipient, wherein the minimizing comprises adjusting the latency to a value allowing for a noise cancelling algorithm to minimize the at least one noise; and providing the audio having the minimized at least one noise to the recipient. Other aspects are described and claimed.

20 Claims, 3 Drawing Sheets

NOISE CANCELLATION USING DYNAMIC LATENCY VALUE

BACKGROUND

Communication methods that are conducted across an electronic mechanism where more than one user calls into a central device, such as conference calls, online meetings, Internet conferencing, and the like, require a user partaking in the call or meeting to access the call or meeting using a device corresponding to the user. These types of calls or meetings will be referred to as conference calls for ease of readability. However, it should be understood that any type of call or meeting where multiple users access a central communication device/facilitator are contemplated herein. The advantage of these calls is that multiple users can access a central communication facilitator from different locations, for example, from separate working locations, from home, or the like. These different environments bring different challenges with the conference calls.

BRIEF SUMMARY

In summary, one aspect provides a method, comprising: detecting audio being supplied across an electronic communication medium, wherein the audio comprises at least one noise other than a speaker; minimizing the at least one noise by dynamically adjusting a latency of the audio being supplied to a recipient, wherein the minimizing comprises adjusting the latency to a value allowing for a noise cancelling algorithm to minimize the at least one noise; and providing the audio having the minimized at least one noise to the recipient Another aspect provides an information handling device, comprising: at least one sensor; a processor; a memory device that stores instructions executable by the processor to: detect audio being supplied across an electronic communication medium, wherein the audio comprises at least one noise other than a speaker; minimize the at least one noise by dynamically adjusting a latency of the audio being supplied to a recipient, wherein to minimize comprises adjusting the latency to a value allowing for a noise cancelling algorithm to minimize the at least one noise; and provide the audio having the minimized at least one noise to the recipient.

A further aspect provides a product, comprising: a storage device that stores code, the code being executable by a processor and comprising: code that detects audio being supplied across an electronic communication medium, wherein the audio comprises at least one noise other than a speaker; code that minimizes the at least one noise by dynamically adjusting a latency of the audio being supplied to a recipient, wherein the minimizing comprises adjusting the latency to a value allowing for a noise cancelling algorithm to minimize the at least one noise; and code that provides the audio having the minimized at least one noise to the recipient.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
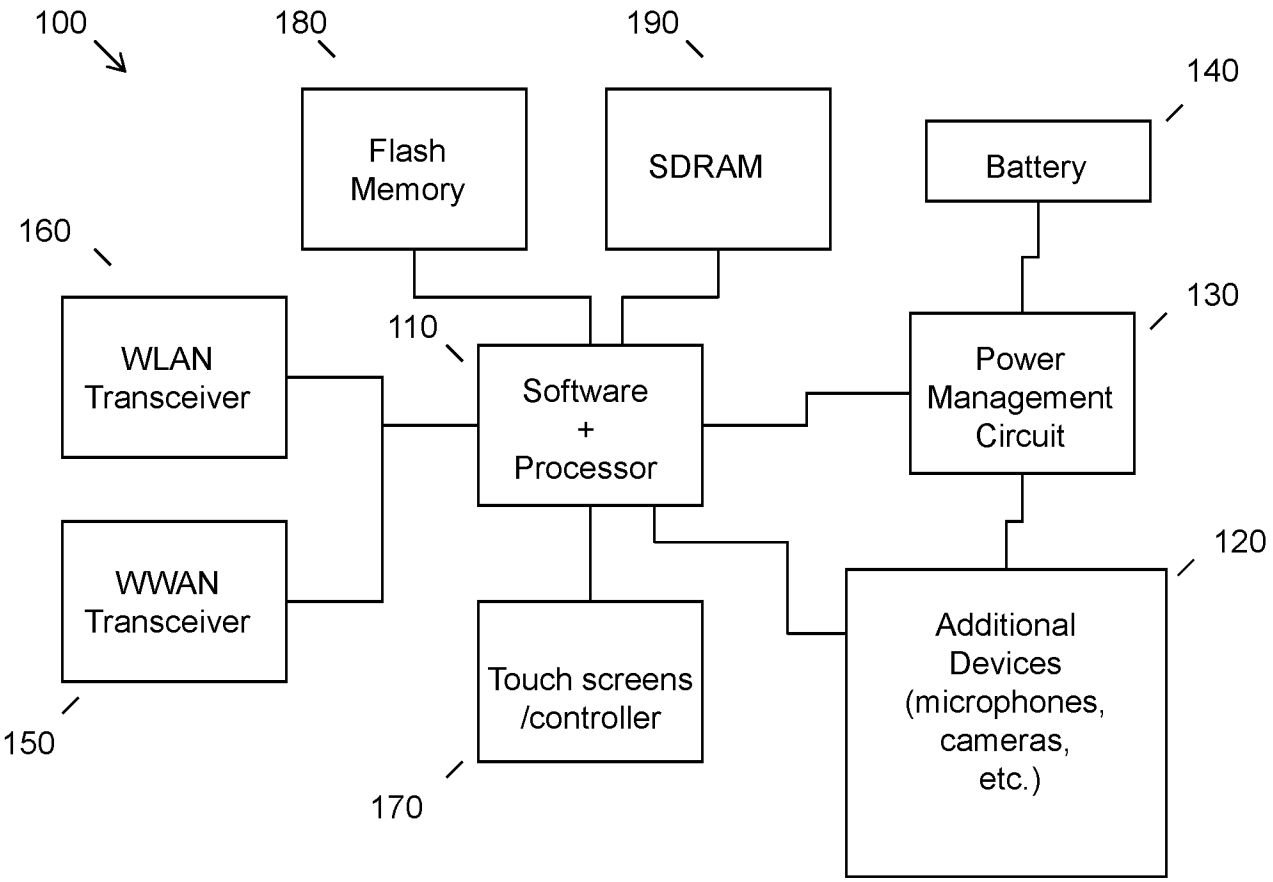
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As more businesses transition to online platforms and employees working remotely, the environments in which employees are working can drastically vary. For example, some employees may work in an area that has some noise and human traffic, for example, in a coffee shop. As another example, some employees may work in even noisier environments, for example, working in an environment with loud music playing, working with a television playing in the background, or the like. As another example, some employees may work in a traditional work environment with other employees talking or working around them. Additionally, some employees may work from less than ideal locations, for example, wherever they are currently located, for example, working in an airport, waiting rooms, or the like.

All working environments have base noise level associated with them, but at any instance the base noise level can be altered. For example, this altering can be the result of an unexpected event occurring, for example, when working in a coffee shop the noise level is routinely moderate, but around 2:30 PM a rush for coffee may be common, increasing the noise level throughout the coffee shop. In other instances, an increase in noise level may not be able to be predicted, but rather a random event occurs, for example, a ceiling tile falling from the ceiling and crashing to the floor in a library. Since a library is a designated quiet place, a ceiling tile crashing to the floor would be highly unexpected and the resulting sound would be excessive and undesirable. Other examples of loud, unpredictable noises include a baby crying, a dog barking, cars honking, and the like.

While a user may be able to deal with different noises within their environments, it becomes more difficult accounting for these noises when the user is on a conference call. Depending on the environment that a user is in when accessing the conference call, the noise associated with the environment of one user can be greater than the background noise of an environment associated with another user. Excessive environmental or background noise can cause interruptions in communication between users, or can become overbearing to the point where users cannot hear each other or are annoyed with the background noises of other users. Ideally, each user participating in a call would be in a quiet environment to allow for clarity of communication; however, background noise can occur anywhere, and sometimes the luxury of a quiet environment is simply not available for a user.

Being present in an environment and participating in a scheduled call produces a need for a technique to filter out background noise for ease of understanding the communicated information. One technique used by users is to mute the microphone when the user is not speaking. However, this does not account for the background noise when the user needs to speak. Thus, noise cancellation techniques can be utilized to assist in minimizing the background noises and support clarity of the relayed information. In conventional methods, noise cancellation techniques can be performed in two separate ways. Noise cancellation generally refers to two different techniques. The first is noise cancellation for a single user within an environment. In this situation, the user is attempting to cancel out the noise of their environment. However, this is not related to audio being provided to another user. Instead this is only related to the single user and their surrounding environment. An example of this method would be the use of noise cancellation headphones by a user.

The second technique refers to minimizing or cancelling noise for recipients of a user communication, for example, across an electronic communication method or technique. These noise cancellation techniques attempt to minimize or cancel noises other than a speaker that are being transmitted across the electronic communication method. Thus, a recipient of the audio would presumably only hear the speaker instead of the background noise, or, at the very least, the background noise would be reduced. When a user included in a conference call is providing information to the additional users in the conversation, the information being provided by the user is the only noise the recipient(s) wants to receive. The additional users do not want to hear the bustling of customers in a coffee shop, the sound of traffic, sneezing or coughing, and the like.

There are conventional techniques to assist in minimizing or cancelling noise from an audio communication. When a user is providing an audio communication across a system and then to at least one recipient, the system receives all the noise being provided from an environment, parses out the desirable information, and then provides the desirable information to the recipient(s). This technique can be time and processing consuming, and the dialogue between users utilizing this method can be choppy and not performed in a natural conversation manner. In other words, this technique causes distortion to the speech itself and causes a delay between the transmission and receipt of the audio. This delay allows the system to parse the audio and filter out or minimize the background noise so that the recipient(s) only hear the desired information.

Accordingly, a system and method is directed toward minimizing background noise included in detected audio captured by a system by dynamically adjusting latency of the audio being provided to a recipient. In other words, a system provides enough delay to the detected audio to allow a noise cancellation algorithm to recognize and remove background noise from the audio. The filtered audio is then provided to the recipient(s). Based upon the type of conversation being had and/or the type of background noise, the length of the latency or a latency value associated with the provided audio to a recipient may vary. A system may also take into account the length of the undesirable sound or noise when determining the latency value that is needed to remove a sound from the supplied audio. Since the system utilizes a dynamic latency value, the amount of interruption to the conversation can be reduced. In other words, the system dynamically chooses a latency value that achieves a balance between minimizing the undesired noise while maintaining the naturalness of the conversation. Thus, utilizing a dynamic latency will permit a system to remove background noise from provided audio while supplying a high-quality conversation between speakers.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally, devices 120 are commonly included, e.g., an image sensor such as a camera, audio capture device such as a microphone, etc. System 100 often includes one or more touch screens 170 for data input and display/rendering. System 100 also typically includes various memory devices, for example flash memory 180 and SDRAM 190.

Figure 2:
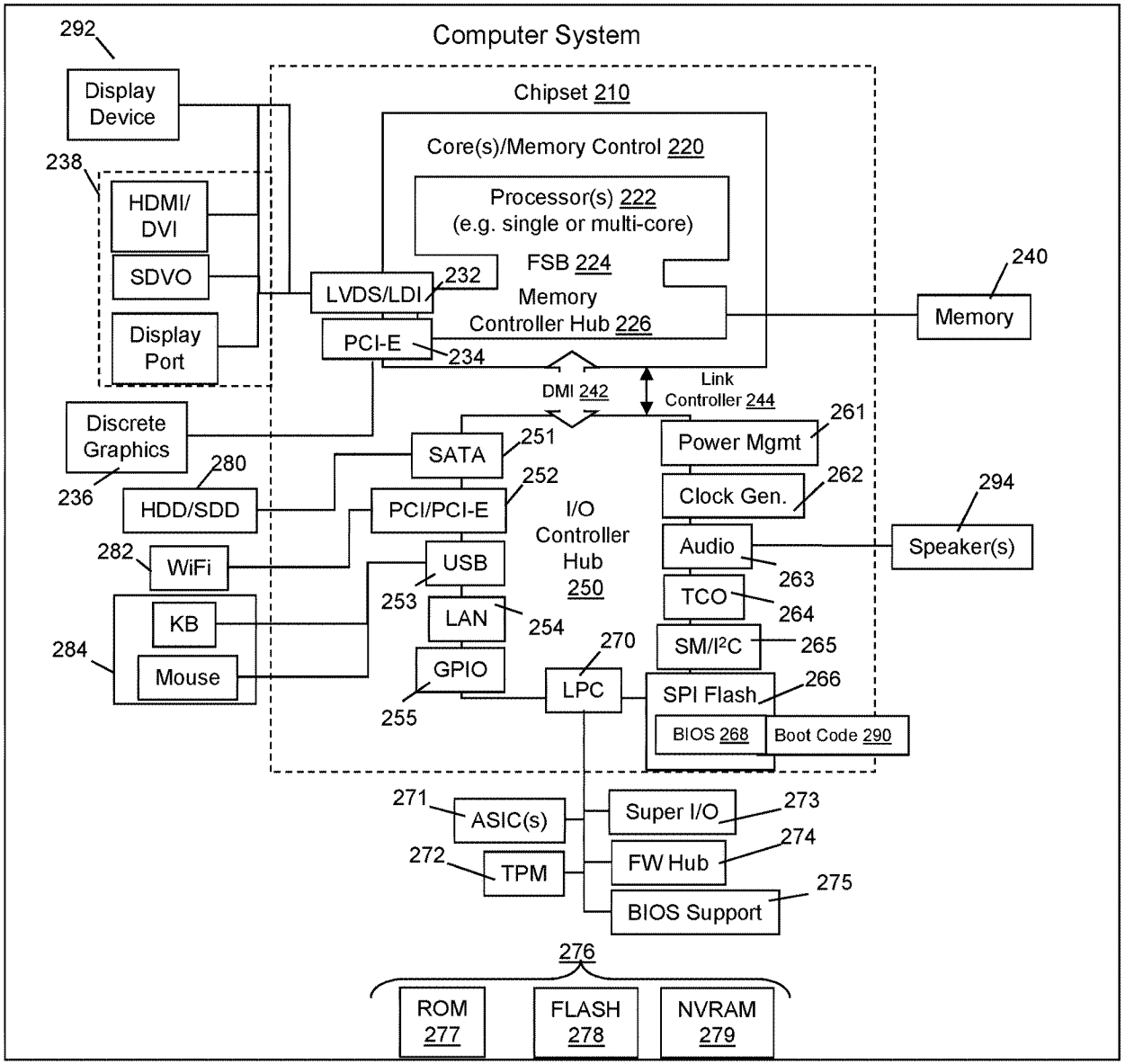
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling circuitry, as for example outlined in FIG. 1 or FIG. 2, may be used in devices that are capable of facilitating an electronic communication between users. For example, the circuitry outlined in FIG. 1 may be implemented in a smart phone or tablet embodiment, whereas the circuitry outlined in FIG. 2 may be implemented in a laptop.

Figure 3:
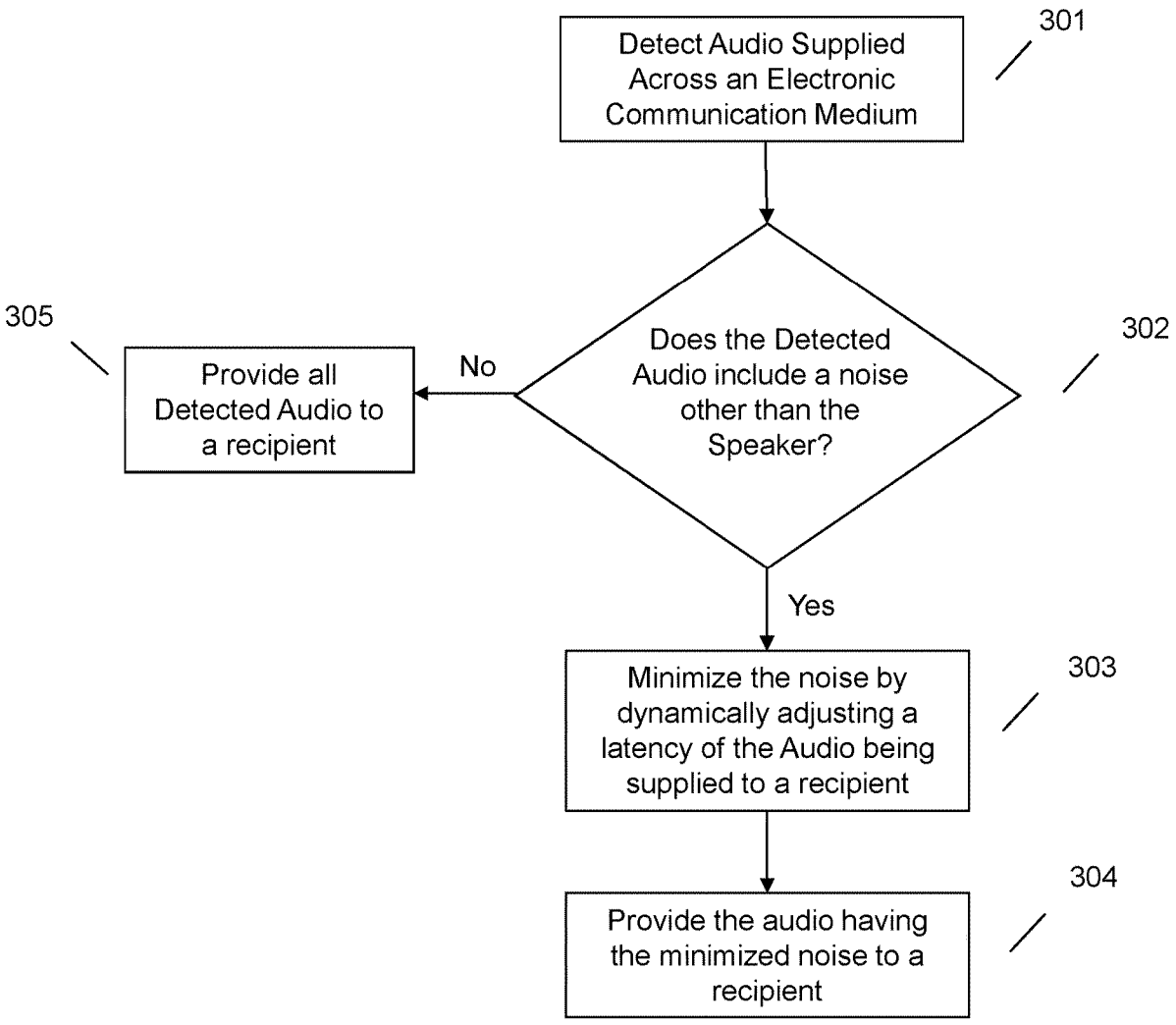
FIG. 3 illustrates an example method of detecting noise not associated with a speaker and removing the detected noise prior to providing audio to a recipient.

Referring now to FIG. 3, an embodiment provides a method of detecting and removing an undesirable noise so that a recipient(s) hears a higher quality audio as compared to conventional noise cancellation techniques. An undesirable noise may be any noise detected by a system that was not supplied by the speaker or associated with the speaker. Commonly, the desirable noise is the speaker's voice; however, any noise associated with the speaker may be accepted by a system. For example, a speaker may play a video with audio or audio recording. This would be a desirable noise. Thus, a desirable noise can be considered any noise that facilitates the communication occurring on the conference call. Conversely, an undesirable noise would be any other noise or a noise that does not facilitate the communication occurring on the conference call.

At 301 a system may detect audio being supplied across an electronic communication medium within an environment. An electronic communication medium may be any system that accepts audio at one end and supplies the audio to a recipient on another end. For ease of understanding, the example of a conference call will be used herein. However, the described system and method is applicable to any system where a user communicates with other users over an electronic communication medium. For example, the described system can be applied to a communication as simple as a phone call between two or more users and a communication as complicated as hundreds or thousands of users logging into an Internet conference to listen to a central speaker. In other words, the described system and method could be applied to a traditional phone call between users and may also be applied to conference calls, Internet conferences, online meetings, screen sharing, or the like. The electronic communication medium may be coupled to the at least one sensor used for detecting or receiving the audio. For example, the sensor may be a microphone or may be a webcam device that captures both audio and video. These sensors are typically associated with a user device.

When detecting the audio being supplied across the electronic communication medium at 301, the system may determine if the detected audio includes a noise other than the noise(s) associated with the speaker at 302. In other words, the system may determine if the audio detected at the system includes one or more undesirable noises. Detection of the undesirable noise can occur at any one of the three devices, a device associated with the speaker, a device associated with the conferencing system, and/or a device associated with a recipient. The device that detects the undesirable noise may be the same device that minimizes or cancels the undesirable noise as discussed below.

Parsing and analyzing the noise sources in the audio may be performed using conventional noise analysis techniques. In other words, detecting the presence of either a desirable or an undesirable noise in the audio may be done utilizing a technique for identifying audio sources. One example technique is a system may recognize and identify frequencies in the audio. The system can then match the identified frequencies to frequencies of a speaker's voice, known sounds (e.g., dogs barking, horns honking, babies crying, etc.), and the like. This allows the system to identify the source of each sound signal within the audio. As another example, a system may determine that a captured noise was provided at the same time the speaker was talking, thereby indicating that the sound was not provided by the speaker. As another example, a system may utilize a sensor coupled to a device, for example, utilizing a video feed provided by a webcam, utilizing a camera on a user's device, or the like, to correlate a sound with an image which allows the system to identify what source provided a sound. Other techniques for identifying sound sources and, therefore, a desirable or undesirable sound are contemplated and possible.

If the audio does not include a noise other than that associated with a speaker, or an undesirable noise, the system may provide all of the detected audio to a recipient at 305, and does not change the latency value associated with the audio. Thus, the latency value of the provided audio may be a nominal latency value or substantially zero. Alternatively, the latency value may be the default latency value of the conferencing system. In other words, the described system does not introduce an additional latency value.

If, on the other hand, the audio does include an undesirable noise, the system may minimize the noise by dynamically adjusting a latency value corresponding to the audio being supplied to a recipient at 303. By dynamically adjusting the latency value, a system may provide a time window for a noise cancellation algorithm to locate the undesirable noise within the detected audio, and remove the noise prior to providing audio to a recipient. The minimization of the undesirable noise may occur at a device of the speaker, a device of the conference system, and/or a device of the recipient.

One noise cancellation algorithm works by identifying a noise signal associated with an undesirable noise and effectively deleting the noise signal, thereby filtering the undesirable noise from the audio. Another noise cancellation algorithm works by identifying a noise signal associated with an undesirable noise and then adding another noise signal into the audio, with the another noise signal being a signal waveform that is the opposite of the signal waveform of the undesirable noise. These two noise signal waveforms then effectively cancel each other and a person listening to the audio does not hear the undesirable noise or the added noise signal. While completely removing the undesirable noise is the preference, noise cancellation algorithms are not perfect all the time. Thus, the noise cancellation may result in a reduced or minimized undesirable noise rather than a completely cancelled or filtered undesirable noise. Thus, a minimized undesirable noise may be either a reduced undesirable noise or a completely filtered or cancelled undesirable noise.

Dynamically adjusting the latency value instead of setting a set latency value allows the system to increase the latency value when it is needed, but decrease the latency value when not needed, for example, when the undesirable noise is nonexistent or very short. Thus, the latency value can be increased in order to give the noise cancellation algorithm time to remove the undesirable noise. Dynamically adjusting the latency value allows for adjusting the latency value as audio is being detected. In other words, the same latency value does not have to be used for the entirety of the detected audio. However, there is a balance between the latency and the effect on the conference call. For example, in the case that the communication is a conversation between users, the system does not want to increase the latency value too much or the conversation will become distorted. Thus, the length of the latency may be based upon a type of communication occurring within the audio. As another example, if only a single speaker is speaking, the length of the latency may be increased significantly more than during a conversation. Thus, a maximum latency value threshold may also be based upon the type of communication. As an extreme example, if only a single speaker is speaking, then the latency value threshold may be minutes, whereas during a conversation the latency value threshold may be 200 milliseconds.

The amount of latency may also be based upon the noise being removed. As an example, the amount of latency may correspond to the length of the undesirable noise. For example, an undesirable noise may be a quick noise that may be removed with a slight increase in the latency value. As another example, the noise cancellation algorithm may be able to minimize or cancel some noises more quickly as compared with other noises. Thus, the noise cancellation algorithm may dictate the latency value based upon the noise that is being minimized or removed. As briefly discussed above, the latency may only be adjusted to a maximum threshold value. If the undesirable noise lasts for longer than the latency, the system may start providing audio to the recipient at the end of the latency. In other words, after the system processes part of the audio (e.g., a portion length corresponding the latency value), the system may provide this part to the recipient and continue to process the next portion(s) of the audio.

Similarly, the length of the latency value may be based upon the source of the undesirable noise. The source may be identified using a sensor coupled to a device. For example, the system may view an environment where the audio is generated and identify the source of each noise detected. For example, the coupled sensor may include an image capture device. Additionally or alternatively, the system may identify a source based on the frequency associated with the sound. Thus, the sensor may be the microphone that is capturing the audio. In one example, a data storage system may include sound frequencies and corresponding identified source. In other words, each sound within the data repository may be labeled with the source that corresponds to the sound. Thus, correlating the detecting frequency with the frequencies included in the data repository allows for identification of the noise source. Once a system minimizes the undesirable noise(s) detected by the system, the audio without the undesirable noise is provided to a recipient at 304.

The various embodiments described herein thus represent a technical improvement to conventional methods of noise cancellation for conference calls. A system may use dynamic noise cancellation techniques when providing audio to a recipient. Based on different factors, a system may determine an appropriate latency value necessary to remove the noise(s) without affecting the quality of the conversation occurring over the electronic communication medium. Responsive to removing the undesirable noise from the detected audio, a system will then provide the audio without the undesirable noise to a recipient. Such a method may more intelligently cancel out noise(s) present in an environment and not being produced by a speaker as compared to traditional systems which use a default latency value that is not adjusted throughout the detection/provision of the audio.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, a system, apparatus, or device (e.g., an electronic, magnetic, optical, electromagnetic, infrared, or semiconductor system, apparatus, or device) or any suitable combination of the foregoing. More specific examples of a storage device/medium include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A method, comprising:

detecting, by use of a sensor associated with an information handling device, audio being supplied across an electronic communication medium, wherein the audio comprises at least one noise other than a speaker;

minimizing the at least one noise by dynamically adjusting a latency of the audio being supplied to a recipient, wherein the minimizing comprises adjusting the latency to a value allowing for a noise cancelling algorithm to minimize the at least one noise, wherein the dynamically adjusting the latency comprises:

identifying a type of communication occurring across the electronic communication medium, wherein the identifying comprises identifying a time length of the at least one noise in the audio of the communication and establishing a maximum latency value threshold based upon the type of communication; and adjusting the latency based upon the time length of the at least one noise and the maximum latency value threshold; and providing the audio having the minimized at least one noise to the recipient.

2. The method of claim 1, wherein the value of the latency is based upon the time length of the at least one noise.

3. The method of claim 1, wherein the noise cancelling algorithm removes the at least one noise other than the user from the audio.

4. The method of claim 1, wherein the value of the latency is based upon a source of the at least one noise.

5. The method of claim 1, wherein the dynamically adjusting comprises adjusting the latency to a value that is not increased above the maximum latency value associated with the type of communication.

6. The method of claim 1, wherein the providing the audio comprises providing at least a portion of the audio during the minimizing of the at least one noise from at least another portion of the audio.

7. The method of claim 1, wherein the dynamically adjusting comprises adjusting the value of the latency dynamically during ongoing detection of the audio.

8. The method of claim 1, wherein the dynamically adjusting comprises adjusting the value of the latency to zero.

9. The method of claim 1, wherein the minimizing occurs at a device selected from the group consisting of: a device associated with a person providing the audio, a device associated with the recipient, and a system device.

10. An information handling device, comprising:

at least one sensor;

a processor;

a memory device that stores instructions executable by the processor to:

detect audio being supplied across an electronic communication medium, wherein the audio comprises at least one noise other than a speaker;

minimize the at least one noise by dynamically adjusting a latency of the audio being supplied to a recipient, wherein to minimize comprises adjusting the latency to a value allowing for a noise cancelling algorithm to minimize the at least one noise, wherein the dynamically adjusting the latency comprises:

identifying a type of communication occurring across the electronic communication medium, wherein the identifying comprises identifying a time length of the at least one noise in the audio of the communication and establishing a maximum latency value threshold based upon the type of communication; and adjusting the latency based upon the time length of the at least one noise and the maximum latency value threshold; and provide the audio having the minimized at least one noise to the recipient.

11. The information handling device of claim 10, wherein the value of the latency is based upon the time length of the at least one noise.

12. The information handling device of claim 10, wherein the noise cancelling algorithm removes the at least one noise other than the user from the audio.

13. The information handling device of claim 10, wherein the value of the latency is based upon a source of the at least one noise.

14. The information handling device of claim 10, wherein the dynamically adjusting comprising adjusting the latency to a value that is not increased above the maximum latency value associated with the type of communication.

15. The information handling device of claim 10, wherein the instructions executable by the processor to provide the audio comprise instructions executable by the processor to provide at least a portion of the audio during the minimizing of the at least one noise from at least another portion of the audio.

16. The information handling device of claim 10, wherein the dynamically adjusting comprises adjusting the value of the latency dynamically during ongoing detection of the audio.

17. The information handling device of claim 10, wherein the dynamically adjusting comprises adjusting the value of the latency to zero.

18. The information handling device of claim 10, wherein the noise cancelling algorithm comprises adding at least one another noise signal into the detected audio;

wherein the at least one another noise signal is a waveform that is opposite of the signal waveform of the at least one noise other than the user.

19. A product, comprising:

a storage device that stores code, the code being executable by a processor and comprising:

code that detects audio being supplied across an electronic communication medium, wherein the audio comprises at least one noise other than a speaker;

code that minimizes the at least one noise by dynamically adjusting a latency of the audio being supplied to a recipient, wherein the minimizing comprises adjusting the latency to a value allowing for a noise cancelling algorithm to minimize the at least one noise, wherein the code that dynamically adjusts the latency comprises code that:

identifies a type of communication occurring across the electronic communication medium, wherein the identifying comprises identifying a time length of the at least one noise in the audio of the communication and establishing a maximum latency value threshold based upon the type of communication; and adjusts the latency based upon the time length of the at least one noise and the maximum latency value threshold; and code that provides the audio having the minimized at least one noise to the recipient.

20. The method of claim 1, wherein the noise cancelling algorithm comprises adding at least one another noise signal into the detected audio;

wherein the at least one another noise signal is a waveform that is opposite of the signal waveform of the at least one noise other than the user.

* * * * *